US009324329B2

(12) United States Patent
Virette et al.

(10) Patent No.: US 9,324,329 B2
(45) Date of Patent: Apr. 26, 2016

(54) METHOD FOR PARAMETRIC SPATIAL AUDIO CODING AND DECODING, PARAMETRIC SPATIAL AUDIO CODER AND PARAMETRIC SPATIAL AUDIO DECODER

(71) Applicant: Huawei Technologies Co., Ltd., Shenzhen (CN)

(72) Inventors: David Virette, Munich (DE); Yue Lang, Munich (DE); Jianfeng Xu, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 71 days.

(21) Appl. No.: 14/145,328

(22) Filed: Dec. 31, 2013

(65) Prior Publication Data

US 2014/0112482 A1 Apr. 24, 2014

Related U.S. Application Data

(63) Continuation of application No. PCT/EP2012/056319, filed on Apr. 5, 2012.

(51) Int. Cl.
*G10L 19/008* (2013.01)
*H04S 3/00* (2006.01)

(52) U.S. Cl.
CPC *G10L 19/008* (2013.01); *H04S 3/00* (2013.01)

(58) Field of Classification Search
None
See application file for complete search history.

(56) References Cited

U.S. PATENT DOCUMENTS

| | | | | |
|---|---|---|---|---|
| 8,346,379 | B2 * | 1/2013 | Lee et al. | 700/94 |
| 2006/0004583 | A1 * | 1/2006 | Herre et al. | 704/500 |
| 2006/0153408 | A1 | 7/2006 | Faller et al. | |
| 2007/0219808 | A1 * | 9/2007 | Herre et al. | 704/500 |
| 2008/0255859 | A1 | 10/2008 | Jung et al. | |
| 2010/0079185 | A1 | 4/2010 | Lee et al. | |

FOREIGN PATENT DOCUMENTS

| | | | |
|---|---|---|---|
| CN | 101223598 | A | 7/2008 |
| CN | 102165520 | A | 8/2011 |

(Continued)

OTHER PUBLICATIONS

Faller, C. et al., "Binaural Cue Coding—Part II: Schemes and Applications", IEEE Transactions on Speech and Audio Processing, vol. 11, No. 6, Nov. 2003, pp. 520-531.*

(Continued)

*Primary Examiner* — Curtis Kuntz
*Assistant Examiner* — Kenny Truong
(74) *Attorney, Agent, or Firm* — Conley Rose, P.C.; Grant Rodolph

(57) ABSTRACT

A method for parametric spatial audio coding of a multi-channel audio signal comprising a plurality of audio channel signals is provided, the method comprising: calculating at least two different spatial coding parameters for an audio channel signal of the plurality of audio channel signals, selecting at least one spatial coding parameter of the at least two different spatial coding parameters associated with the audio channel signal on the basis of the values of the calculated spatial coding parameters; including a quantized representation of the selected spatial coding parameter into a parameter section of an audio bitstream; and setting a parameter type flag in the parameter section of the audio bitstream indicating the type of the selected spatial coding parameter being included into the audio bitstream.

16 Claims, 5 Drawing Sheets

(56) References Cited

FOREIGN PATENT DOCUMENTS

| | | | |
|---|---|---|---|
| EP | 2128856 | A1 | 2/2009 |
| EP | 2169666 | A1 | 3/2010 |
| JP | 2008527431 | A | 7/2008 |
| JP | 2009512893 | A | 3/2009 |
| JP | 2012503791 | A | 2/2012 |
| KR | 20100035121 | A | 4/2010 |
| WO | 2004008806 | A1 | 1/2004 |

OTHER PUBLICATIONS

Foreign Communication From a Counterpart Application, PCT Application No. PCT/EP2012/056319, International Search Report dated Dec. 21, 2012, 4 pages.
Foreign Communication From a Counterpart Application, PCT Application No. PCT/EP2012/056319, Written Opinion dated Dec. 21, 2012, 5 pages.
"Series G: Transmission Systems and Media, Digital Systems and Networks, Digital Terminal Equipments—Coding of Voice and Audio Signals, Wideband Embedded Extension for ITU-T G.711 Pulse Code Modulation," ITU-T, Telecommunication Standardization Sector of ITU, G.711.1, Sep. 2012, 218 pages.
"Series G: Transmission Systems and Media, Digital Systems and Networks, Digital Terminal Equipments—Coding of Voice and Audio Signals, 7 kHz Audio-Coding within 64 kbit/s," ITU-T, Telecommunication Standardization Sector of ITU, G.722, Sep. 2012, 274 pages.
Faller, C., et al., "Efficient Representation of Spatial Audio Using Perceptual Parametrization," Media Signal Processing Research, IEEE Workshop on Applications of Signal Processing to Audio and Acoustics, 2001, pp. 199-202.
Baumgarte, F., et al., "Binaural Cue Coding—Part I: Psychoacoustic Fundamentals and Design Principles," IEEE Transactions on Speech and Audio Processing, vol. 11, No. 6, Nov. 2003, pp. 509-519.
Faller, C., et al., "Binaural Cue Coding—Part II: Schemes and Applications," IEEE Transactions on Speech and Audio Processing, vol. 11, No. 6, Nov. 2003, pp. 520-531.
Breebaart, J., et al., "Parametric Coding of Stereo Audio," EURASIP Journal on Applied Signal Processing, Sep. 2005, pp. 1305-1322.
Partial English Translation and Abstract of Chinese Patent Application No. CN102165520A, Oct. 13, 2014, 60 pages.
Foreign Communication From a Counterpart Application, Chinese Application No. 201280003212.4, Chinese Search Report dated Sep. 11, 2014, 2 pages.
Foreign Communication From a Counterpart Application, Chinese Application No. 201280003212.4, Chinese Office Action dated Sep. 22, 2014, 4 pages.
Foreign Communication From a Counterpart Application, Korean Application No. 10-2014-7029854, Korean Office Action dated Aug. 21, 2015, 5 pages.
Foreign Communication From a Counterpart Application, Korean Application No. 10-2014-7029854, English Translation of Korean Office Action dated Sep. 3, 2015, 8 pages.
Partial English Translation and Abstract of Japanese Patent Application No. JP2008527431, Dec. 28, 2015, 65 pages.
Partial English Translation and Abstract of Japanese Patent Application No. JP2009512893, Dec. 28, 2015, 30 pages.
Partial English Translation and Abstract of Japanese Patent Application No. JP2012503791, Dec. 28, 2015, 69 pages.
Foreign Communication From a Counterpart Application, Japanese Application No. 2015503764, Japanese Office Action dated Oct. 13, 2015, 3 pages.
Foreign Communication From a Counterpart Application, Japanese Application No. 2015503764, English Translation of Japanese Office Action dated Oct. 13, 2015, 3 pages.

* cited by examiner

METHOD FOR PARAMETRIC SPATIAL AUDIO CODING AND DECODING, PARAMETRIC SPATIAL AUDIO CODER AND PARAMETRIC SPATIAL AUDIO DECODER

CROSS-REFERENCE TO RELATED APPLICATIONS

This application is a continuation of International Application No. PCT/EP2012/056319, filed on Apr. 5, 2012, which is hereby incorporated by reference in its entirety.

TECHNICAL FIELD

The present invention pertains to a method for parametric spatial audio coding and decoding, a parametric spatial audio coder and a parametric spatial audio decoder for multi-channel audio signals.

BACKGROUND

Parametric multi-channel audio coding is described in Faller, C., Baumgarte, F.: "Efficient representation of spatial audio using perceptual parametrization", Proc. IEEE Workshop on Appl. of Sig. Proc. to Audio and Acoust., October 2001, pp. 199-202. Downmixed audio signals may be upmixed to synthesize multi-channel audio signals, using spatial cues to generate more output audio channels than downmixed audio signals. Usually, the downmixed audio signals are generated by superposition of a plurality of audio channel signals of a multi-channel audio signal, for example a stereo audio signal. The downmixed audio signals are waveform coded and put into an audio bitstream together with auxiliary data relating to the spatial cues. The decoder uses the auxiliary data to synthesize the multi-channel audio signals based on the waveform coded audio channels.

There are several spatial cues or parameters that may be used for synthesizing multi-channel audio signals. First, the inter-channel level difference (ILD) indicates a difference between the levels of audio signals on two channels to be compared. Second, the inter-channel time difference (ITD) indicates the difference in arrival time of sound between the ears of a human listener. The ITD value is important for the localization of sound, as it provides a cue to identify the direction or angle of incidence of the sound source relative to the ears of the listener. Third, the inter-channel phase difference (IPD) specifies the relative phase difference between the two channels to be compared. A subband IPD value may be used as an estimate of the subband ITD value. Finally, inter-channel coherence (ICC) is defined as the normalized inter-channel cross-correlation after a phase alignment according to the ITD or IPD. The ICC value may be used to estimate the width of a sound source.

ILD, ITD, IPD and ICC are important parameters for spatial multi-channel coding/decoding. ITD may for example cover the range of audible delays between −1.5 milliseconds (ms) to 1.5 ms. IPD may cover the full range of phase differences between $-\pi$ and $\pi$. ICC may cover the range of correlation and may be specified in a percentage value between 0 and 1 or other correlation factors between −1 and +1. In current parametric stereo coding schemes, ILD, ITD, IPD and ICC are usually estimated in the frequency domain. For every subband, ILD, ITD, IPD and ICC are calculated, quantized, included in the parameter section of an audio bitstream and transmitted.

Due to restrictions in bitrates for parametric audio coding schemes there are sometimes not enough bits in the parameter section of the audio bitstream to transmit all of the ILD, ITD, IPD and ICC values. For example, the document U.S. Patent Application Publication 2011/0173005 A1 discloses a coding scheme for audio signals on the basis of an audio signal classification.

SUMMARY

An idea of the present invention is to transmit only a select number of spatial coding parameters at a time, depending on the characteristic of the input signal and perceptual importance of the spatial coding parameters. The selected spatial coding parameter to be transmitted should cover the full band and represent the globally most important perceptual difference between the channels.

With the present invention, it is possible to use the perceptual importance of the various spatial coding parameters and to prioritize the most important parameters for inclusion into the encoded audio bitstream. The selection causes the needed bitrate of the bitstream to be lowered since not all spatial coding parameters are transmitted at the same time.

Consequently, a first aspect of the present invention relates to a method for spatial audio coding of a multi-channel audio signal comprising a plurality of audio channel signals, the method comprising: calculating at least two different spatial coding parameters for an audio channel signal of the plurality of audio channel signals, wherein the at least two different spatial coding parameters are of at least two different types of spatial coding parameters and are calculated with regard to a reference audio signal, wherein the reference audio signal is another audio channel signal of the plurality of audio-channel signals or a downmix audio signal derived from at least two audio channel signals of the plurality of audio channel signals; selecting at least one spatial coding parameter of the at least two different spatial coding parameters associated with the audio channel signal on the basis of the values of the calculated spatial coding parameters; including a quantized representation of the selected spatial coding parameter into a parameter section of an audio bitstream; and setting a parameter type flag in the parameter section of the audio bitstream indicating the type of the selected spatial coding parameter being included into the audio bitstream.

According to a first implementation of the first aspect the method further comprises including a quantized representation of a predetermined flag value into the parameter section of the audio bitstream, and including a quantized representation of the selected spatial coding parameter into a parameter section of the audio bitstream together with the quantized representation of a predetermined flag value, thereby indicating the type of the selected spatial coding parameter being included into the audio bitstream.

According to a second implementation of the first aspect as such or according to the first implementation of the first aspect the quantized representation of the selected spatial coding parameter includes 4 bits.

According to a third implementation of the second implementation of the first aspect the parameter type flag includes 1 bit.

According to an even further implementation of the second implementation of the first aspect or the further implementation thereof the quantized representation of the predetermined flag value includes 4 bits.

According to a fourth implementation of the first aspect as such or according to any of the preceding implementations of the first aspect the parameter type flag includes 2 bits.

According to a fifth implementation of the first aspect as such or according to any of the preceding implementations of the first aspect an ITD value is quantized to 15 quantization values.

According to a sixth implementation of the first aspect as such or according to any of the preceding implementations of the first aspect an IPD value is quantized to 15 quantization values.

According to a seventh implementation of the first aspect as such or according to any of the preceding implementations of the first aspect an ICC value is quantized to 4 quantization values.

According to an eighth implementation of the first aspect as such or according to any of the preceding implementations of the first aspect the step of selecting at least one spatial parameter comprises: selecting a first spatial coding parameter of a first spatial coding parameter type from the at least two spatial coding parameters in case the value of the first spatial coding parameter fulfills a predetermined first selection criterion associated to the first spatial coding parameter type; and/or selecting a second spatial coding parameter of a second spatial coding parameter type from the at least two spatial coding parameters in case the value of the first spatial coding parameter does not fulfill the predetermined first selection criterion associated to the first spatial coding parameter type and the value of the second spatial coding parameter fulfills a predetermined second selection criterion associated to the second spatial coding parameter type.

According to a ninth implementation of the first aspect as such or according to any of the preceding implementations of the first aspect the types of the spatial coding parameters are inter-channel time difference (ITD), inter-channel phase difference (IPD), inter-channel level difference (ILD), or inter-channel coherence (ICC).

According to a ninth implementation of the first aspect as such or according to any of the preceding implementations of the first aspect, the step of selecting at least one spatial coding parameter comprises selecting only one spatial coding parameter of the plurality of spatial coding parameters for the audio channel signal.

According to a second aspect of the present invention, a spatial audio coding device for a multi-channel audio signal comprising a plurality of audio channel signals is provided, the spatial audio coding device comprising: a parameter estimation module configured to calculate at least two different spatial coding parameters for an audio channel signal of the plurality of audio channel signals, wherein the at least two different spatial coding parameters are of at least two different types of spatial coding parameters and are calculated with regard to a reference audio signal, wherein the reference audio signal is another audio channel signal of the plurality of audio-channel signals or a downmix audio signal derived from at least two audio channel signals of the plurality of audio channel signals; a parameter selection module coupled to the parameter estimation module and configured to select at least one spatial coding parameter of the at least two different spatial coding parameters associated with the audio channel signal on the basis of the values of the calculated spatial coding parameters; and a streaming module coupled to the parameter estimation module and the parameter selection module and configured to generate an audio bitstream comprising a parameter section comprising a quantized representation of the selected spatial coding parameter and to set a parameter type flag in the parameter section of the audio bitstream indicating the type of the selected spatial coding parameter being included into the audio bitstream.

According to a first implementation of the second aspect, the spatial audio coding device further comprises a downmixing module configured to generate a downmix audio signal by downmixing the plurality of audio channel signals.

According to a first implementation of the first implementation of the second aspect, the spatial audio coding device further comprises an encoding module coupled to the downmixing module and configured to generate an encoded audio bitstream comprising the encoded downmixed audio signal.

According to a second implementation of the second aspect or according to any preceding implementation of the second aspect, the spatial audio coding device further comprises a transformation module configured to apply a transformation from a time domain to a frequency domain to the plurality of audio channel signals.

According to a first implementation of the second implementation of the second aspect the streaming module is further configured to set a flag in the audio bitstream, the flag indicating the presence of at least one spatial coding parameter in the parameter section of the audio bitstream.

According to a first implementation of the first implementation of the second implementation of the second aspect the flag is set for the whole audio bitstream or comprised in the parameter section of the audio bitstream.

According to a third implementation of the second aspect or according to any preceding implementation of the second aspect the parameter selection module is further configured to: select a first spatial coding parameter of a first spatial coding parameter type from the at least two spatial coding parameters in case the value of the first spatial coding parameter fulfills a predetermined first selection criterion associated to the first spatial coding parameter type; and/or select a second spatial coding parameter of a second spatial coding parameter type from the at least two spatial coding parameters in case the value of the first spatial coding parameter does not fulfill the predetermined first selection criterion associated to the first spatial coding parameter type and the value of the second spatial coding parameter fulfills a predetermined second selection criterion associated to the second spatial coding parameter type.

According to a fourth implementation of the first aspect as such or according to any of the preceding implementations of the first aspect, the parameter selection module is configured to select only one spatial coding parameter of the plurality of spatial coding parameters for the audio channel signal.

According to a third aspect of the present invention, a spatial audio decoding device comprises a parameter detection module configured to detect a parameter type flag in a parameter section of a received audio bitstream indicating a type of a selected spatial coding parameter being included into the audio bitstream, a selection module configured to read at least one spatial coding parameter from the parameter section of the received audio bitstream according to the detected parameter type, and an upmixing module coupled to the selection module and configured to upmix a decoded audio signal from a downmixed audio bitstream included in the audio bitstream to a plurality of audio channel signals of a multi-channel signal using the read at least one spatial coding parameter from the parameter section of the received audio bitstream.

According to a fourth aspect of the present invention, a spatial audio decoding method is provided, the method comprising: detecting a parameter type flag in a parameter section of a received audio bitstream indicating a type of a selected spatial coding parameter being included into the audio bitstream; reading at least one spatial coding parameter from the parameter section of the received audio bitstream according to the detected parameter type; and upmixing a decoded downmixed audio signal from a downmixed audio bitstream included in the audio bitstream to a plurality of audio channel signals of a multi-channel signal using the read at least one spatial coding parameter from the parameter section of the received audio bitstream.

According to a fifth aspect of the present invention, a computer program is provided, the computer program comprising a program code for performing the method according to the first and fourth aspect or any of their implementations when run on a computer.

The methods described herein may be implemented as software in a Digital Signal Processor (DSP), in a microcontroller or in any other side-processor or as hardware circuit within an application specific integrated circuit (ASIC).

The invention can be implemented in digital electronic circuitry, or in computer hardware, firmware, software, or in combinations thereof.

Additional embodiments and implementations may be readily understood from the following description. In particular, any features from the embodiments, aspects and implementations as set forth hereinbelow may be combined with any other features from the embodiments, aspects and implementations, unless specifically noted otherwise.

BRIEF DESCRIPTION OF DRAWINGS

The accompanying drawings are included to provide a further understanding of the disclosure. They illustrate embodiments and may help to explain the principles of the invention in conjunction with the description. Other embodiments and many of the intended advantages, envisaged principles and functionalities will be appreciated as they become better understood by reference to the detailed description as following hereinbelow. The elements of the drawings are not necessarily drawn to scale relative to each other. In general, like reference numerals designate corresponding similar parts.

DESCRIPTION OF EMBODIMENTS

In the following detailed description, reference is made to the accompanying drawings, and in which, by way of illustration, specific embodiments are shown. It should be obvious that other embodiments may be utilized and structural or logical changes may be made without departing from the scope of the present invention. Unless specifically noted otherwise, functions, principles and details of each embodiment may be combined with other embodiments. Generally, this application is intended to cover any adaptations or variations of the specific embodiments discussed herein. Hence, the following detailed description is not to be taken in a limiting sense, and the scope of the present invention is defined by the appended claims.

Embodiments may include methods and processes that may be embodied within machine readable instructions provided by a machine readable medium, the machine readable medium including, but not being limited to devices, apparatuses, mechanisms or systems being able to store information which may be accessible to a machine such as a computer, a calculating device, a processing unit, a networking device, a portable computer, a microprocessor or the like. The machine readable medium may include volatile or non-volatile media as well as propagated signals of any form such as electrical signals, digital signals, logical signals, optical signals, acoustical signals, acousto-optical signals or the like, the media being capable of conveying information to a machine.

In the following, reference is made to methods and method steps, which are schematically and exemplarily illustrated in flow charts and block diagrams. It should be understood that the methods described in conjunction with those illustrative drawings may easily be performed by embodiments of systems, apparatuses and/or devices as well. In particular, it should be obvious that the systems, apparatuses and/or devices capable of performing the detailed block diagrams and/or flow charts are not necessarily limited to the systems, apparatuses and/or devices shown and detailed herein below, but may rather be different systems, apparatuses and/or devices. The terms "first", "second", "third", etc. are used merely as labels, and are not intended to impose numerical requirements on their objects or to establish a certain ranking of importance of their objects.

Figure 1:
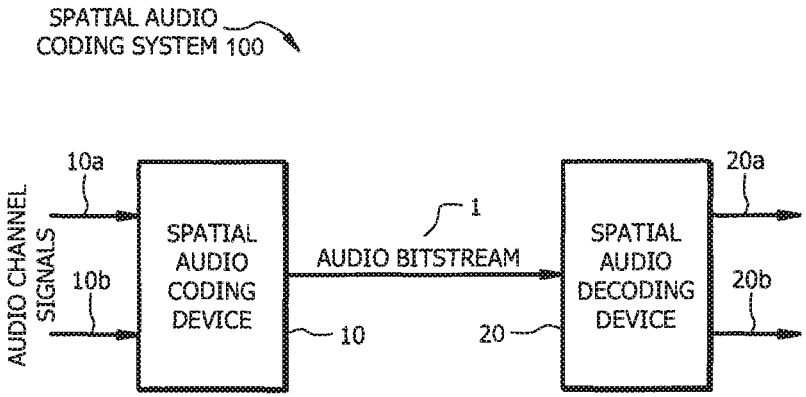
FIG. 1 schematically illustrates a spatial audio coding system.

FIG. 1 schematically illustrates a spatial audio coding system 100. The spatial audio coding system 100 comprises a spatial audio coding device 10 and a spatial audio decoding device 20. A plurality of audio channel signals 10*a*, 10*b*, of which only two are exemplarily shown in FIG. 1, are input to the spatial audio coding device 10. The spatial audio coding device 10 encodes and downmixes the audio channel signals 10*a*, 10*b* and generates an audio bitstream 1 that is transmitted to the spatial audio decoding device 20. The spatial audio decoding device 20 decodes and upmixes the audio data included in the audio bitstream 1 and generates a plurality of output audio channel signals 20*a*, 20*b*, of which only two are exemplarily shown in FIG. 1. The number of audio channel signals 10*a*, 10*b* and 20*a*, 20*b*, respectively, is in principle not limited. For example, the number of audio channel signals 10*a*, 10*b* and 20*a*, 20*b* may be two for binaural stereo signals. For example the binaural stereo signals may be used for three-dimensional (3D) audio or headphone-based surround rendering, for example with head-related transfer function (HRTF) filtering.

The spatial audio coding system 100 may be applied for encoding of the stereo extension of ITU-T G.722, G. 722 Annex B, G.711.1 and/or G.711.1 Annex D. Moreover, the spatial audio coding system 100 may be used for speech and audio coding/decoding in mobile applications, such as defined in Third Generation Partnership Project (3GPP) Enhanced Voice Services (EVS) codec.

Figure 2:
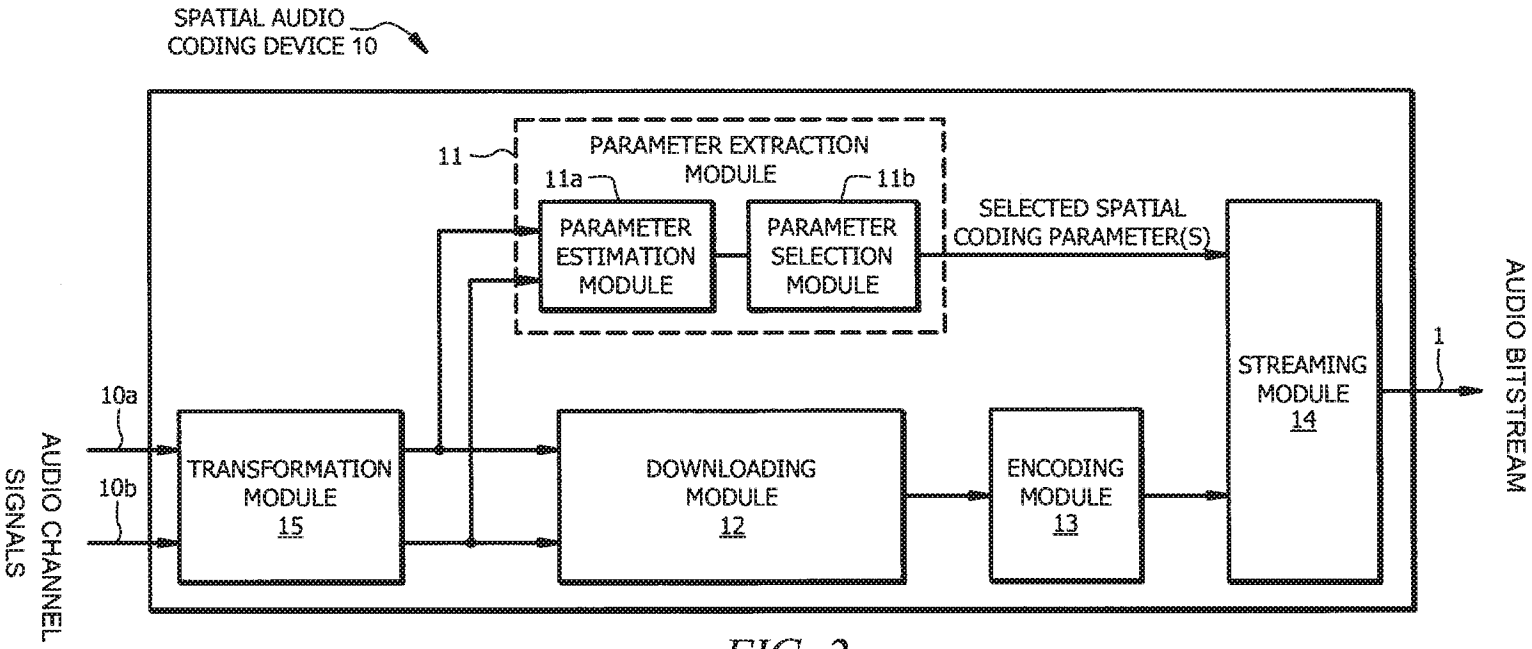
FIG. 2 schematically illustrates a spatial audio coding device.

FIG. 2 schematically shows the spatial audio coding device 10 of FIG. 1 in greater detail. The spatial audio coding device 10 may comprise a transformation module 15, a parameter extraction module 11 coupled to the transformation module 15, a downmixing module 12 coupled to the transformation module 15, an encoding module 13 coupled to the downmixing module 12 and a streaming module 14 coupled to the encoding module 13 and the parameter extraction module 11.

The transformation module 15 may be configured to apply a transformation from a time domain to a frequency domain to a plurality of audio channel signals 10*a*, 10*b* input to the spatial audio coding device 10. The downmixing module 12 may be configured to receive the transformed audio channel signals 10*a*, 10*b* from the transformation module 15 and to generate at least one downmixed audio channel signal by downmixing the plurality of transformed audio channel signals 10*a*, 10*b*. The number of downmixed audio channel signals may for example be less than the number of transformed audio channel signals 10*a*, 10*b*. For example, the downmixing module 12 may be configured to generate only one downmixed audio channel signal. The encoding module 13 may be configured to receive the downmixed audio channel signals and to generate an encoded audio bitstream comprising the encoded downmixed audio channel signals.

The parameter extraction module 11 may comprise a parameter estimation module 11*a* that may be configured to receive the plurality of audio channel signals 10*a*, 10*b* as input and to calculate at least two different spatial coding parameters for an audio channel signal of the plurality of audio channel signals, wherein the at least two different spatial coding parameters are of at least two different types of spatial coding parameters and are calculated with regard to a reference audio signal, wherein the reference audio signal is another audio channel signal of the plurality of audio-channel signals or a downmix audio signal derived from at least two audio channel signals of the plurality of audio channel signals The parameter extraction module 11 may further comprise a parameter selection module 11*b* coupled to the parameter estimation module 11*a* and configured to select at least one spatial coding parameter of the at least two different spatial coding parameters associated with the audio channel signal on the basis of the values of the calculated spatial coding parameters.

Embodiments of the parameter extraction module 11, respectively of the parameter selection module 11*b* may be adapted to select a spatial coding parameter for each audio channel signal, wherein the selected spatial coding parameter may be of a different spatial coding parameter type for the different audio channel signals.

Embodiments of the parameter extraction module 11, respectively of the parameter selection module 11*b* may be adapted to select a first spatial coding parameter of a first spatial coding parameter type, e.g. ITD, from the at least two spatial coding parameters, e.g. ITD, IPD and ICC, in case the value of the first spatial coding parameter fulfills a predetermined first selection criterion associated to the first spatial coding parameter type; and/or to select a second spatial coding parameter of a second spatial coding parameter type, e.g. IPD, from the at least two spatial coding parameters, e.g. ITD, IPD and ICC, in case the value of the first spatial coding parameter does not fulfill the predetermined first selection criterion associated to the first spatial coding parameter type and the value of the second spatial coding parameter fulfills a predetermined second selection criterion associated to the second spatial coding parameter type.

Further embodiments of parameter extraction module 11, respectively of the parameter selection module 11*b* may be adapted to select only one spatial coding parameter of the plurality of spatial coding parameters for one audio channel signal.

The selected spatial coding parameter(s) may then be input to the streaming module 14 which may be configured to generate the output audio bitstream 1 comprising the encoded audio bitstream from the encoding module 13 and a parameter section comprising a quantized representation of the selected spatial coding parameter(s). The streaming module 14 may further be configured to set a parameter type flag in the parameter section of the audio bitstream 1 indicating the type of the selected spatial coding parameter(s) being included into the audio bitstream 1.

Additionally, the streaming module 14 may further be configured to set a flag in the audio bitstream 1, the flag indicating the presence of at least one spatial coding parameter in the parameter section of the audio bitstream 1. This flag may be set for the whole audio bitstream 1 or comprised in the parameter section of the audio bitstream 1. That way, the signaling of the type of the selected spatial coding parameter(s) being included into the audio bitstream 1 may be signalled explicitly or implicitly to the spatial audio decoding device 20. It may be possible to switch between the explicit and implicit signaling schemes.

In the case of implicit signaling, the flag may indicate the presence of the spatial coding parameter(s) in the auxiliary data in the parameter section. A legacy spatial audio decoding device 20 does not check whether such a flag is present and thus only decodes the encoded audio bitstream. On the other hand, a non-legacy, i.e. up-to-date spatial audio decoding device 20 may check the presence of such a flag in the received audio bitstream 1 and reconstruct the multi-channel audio channel signal 20*a*, 20*b* based on the additional full band spatial coding parameters included in the parameter section of the audio bitstream 1.

When using explicit signaling, the whole audio bitstream 1 may be flagged as containing spatial coding parameters. That way, a legacy spatial audio decoding device 20 is not able to decode the bitstream and thus discards the audio bitstream 1. On the other hand, an up-to-date spatial audio decoding device 20 may decide on whether to decode the audio bitstream 1 as a whole or only to decode the encoded audio bitstream 1 while neglecting the spatial coding parameters. The benefit of the explicit signaling may be seen in that, for example, a new mobile terminal can decide what parts of an audio bitstream to decode in order to save energy and thus extend the battery life of an integrated battery. Decoding spatial coding parameters is usually more complex and requires more energy. Additionally, depending on the rendering system, the up-to-date spatial audio decoding device 20 may decide which part of the audio bitstream 1 should be decoded. For example, for rendering with headphones it may be sufficient to only decode the encoded audio bitstream, while the multi-channel audio channel signal 20*a*, 20*b* is decoded only when the mobile terminal is connected to a docking station with such multi-channel rendering capability.

Figure 3:
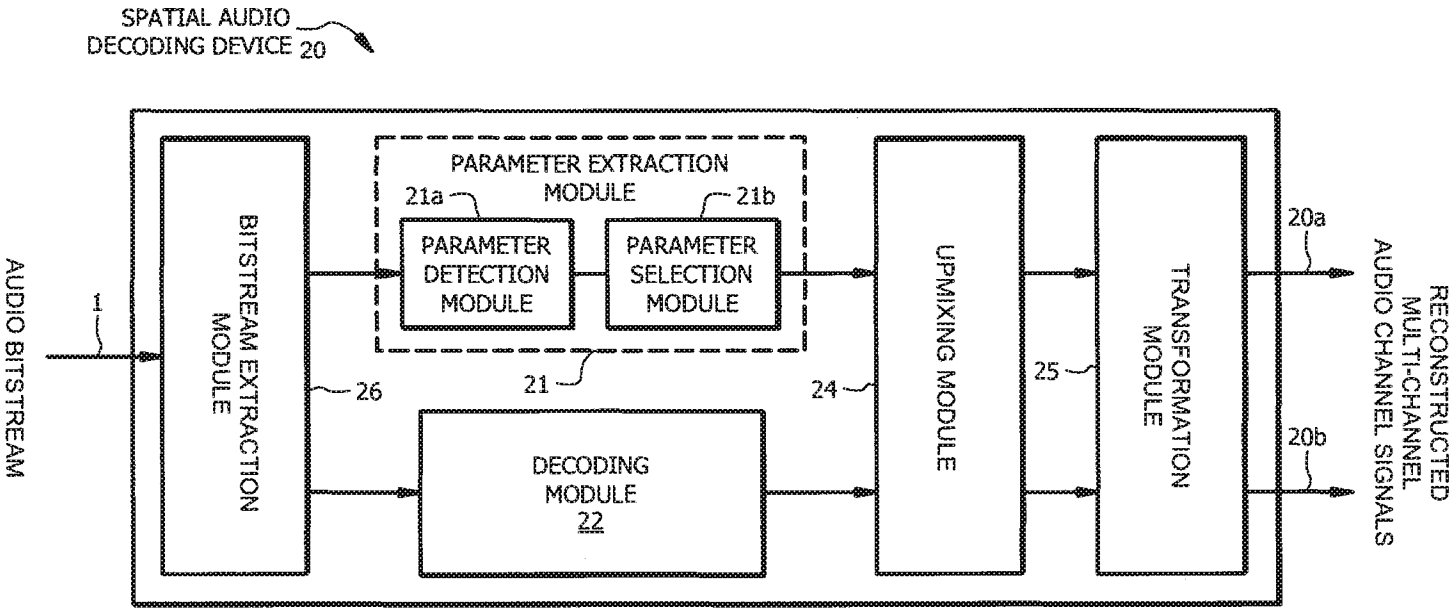
FIG. 3 schematically illustrates a spatial audio decoding device.

FIG. 3 schematically shows the spatial audio decoding device 20 of FIG. 1 in greater detail. The spatial audio decoding device 20 may comprise a bitstream extraction module 26, a parameter extraction module 21, a decoding module 22, an upmixing module 24 and a transformation module 25. The bitstream extraction module 26 may be configured to receive an audio bitstream 1 and separate the parameter section and the encoded audio bitstream enclosed in the audio bitstream 1. The parameter extraction module 21 may comprise a parameter detection module 21*a* configured to detect a parameter type flag in the parameter section of a received audio bitstream 1 indicating a type of a selected spatial coding parameter being included into the audio bitstream 1. The parameter extraction module 21 may further comprise a selection module 21*b* coupled to the parameter detection module 21*a* and configured to read at least one spatial coding parameter from the parameter section of the received audio bitstream 1 according to the detected parameter type.

The decoding module 22 may be configured to decode the encoded audio bitstream 1 and to input the decoded audio signal into the upmixing module 24. The upmixing module 24 may be coupled to the selection module 21*b* and configured to upmix the decoded audio signal to a plurality of audio channel signals using the read at least one spatial coding parameter from the parameter section of the received audio bitstream 1 as provided by the selection module 21*b*. Finally, the transformation module 25 may be coupled to the upmixing module 24 and configured to transform the plurality of audio channel signals from a frequency domain to a time domain for reproduction of sound on the basis of the plurality of audio channel signals and to output the reconstructed multi-channel audio channel signals 20*a*, 20*b*.

Figure 4:
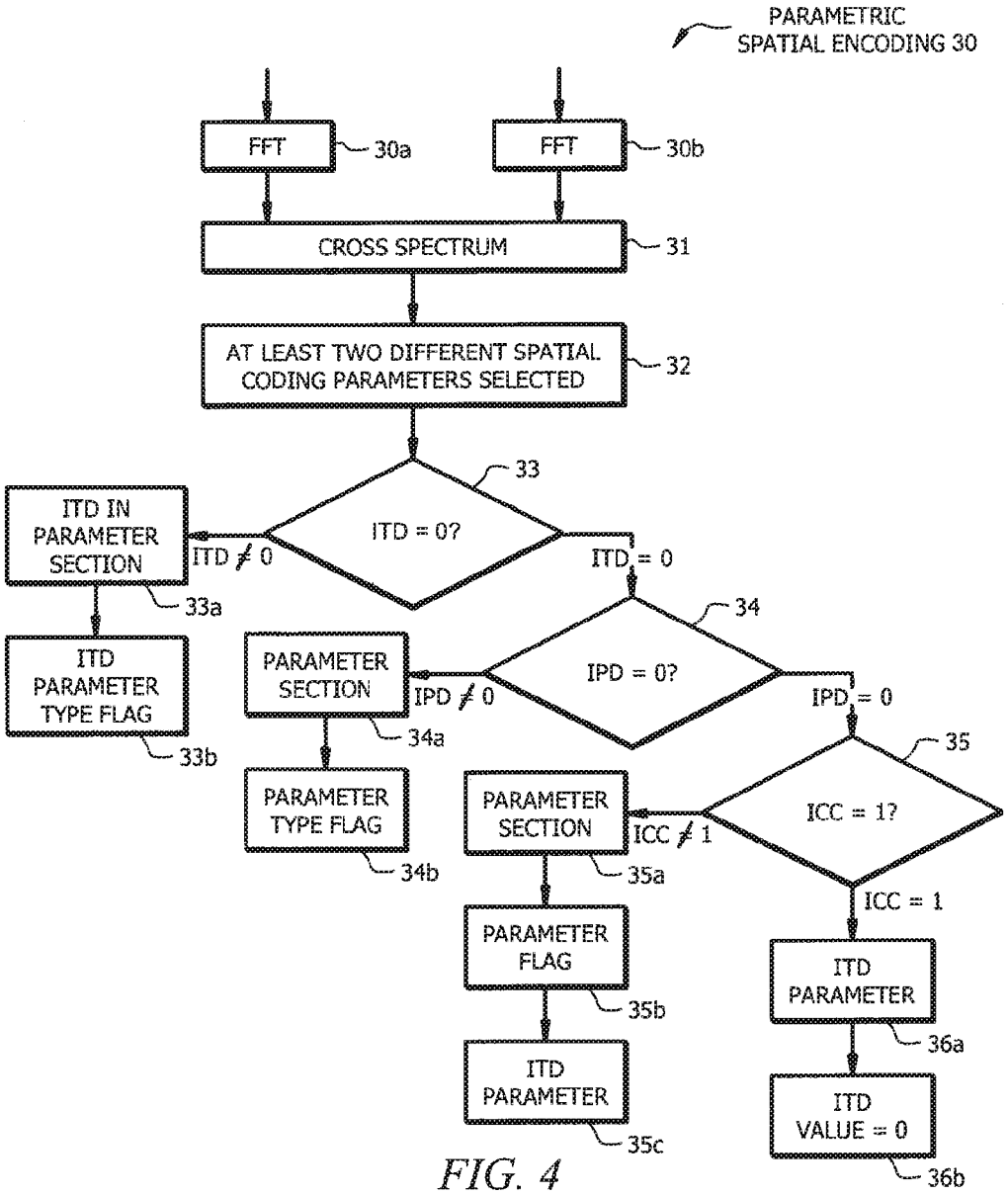
FIG. 4 schematically illustrates a first embodiment of a method for parametric spatial encoding.

FIG. 4 schematically shows a first embodiment of a method 30 for parametric spatial encoding. The method 30 comprises in a first step performing a time frequency transformation on input channels. In case of a stereo signal comprising a left channel signal and a right channel signal, a first transformation is performed at step 30*a* on the left channel signal and a second transformation is performed at step 30*b* on the right channel signal. The transformation may in each case be performed using Fast Fourier transformation (FFT). Alternatively, Short Term Fourier Transformation (STFT), cosine modulated filtering or complex filtering may be performed.

In a second step 31, a cross spectrum may be computed per subband b as $$c[b]=\Sigma_{k=k_b}^{kb+1-1}X_1[k]\cdot X_2[k]^*,$$

wherein X1[k] and X2[k] are the FFT coefficients of the two channels or two audio channel signals 1 and 2, for example the left and the right channel signals in case of stereo. "*" denotes the complex conjugation, kb denotes the start bin of the subband b and kb+1 denotes the start bin of the neighbouring subband b+1. Hence, the frequency bins [k] of the FFT from kb to kb+1 represent the subband b.

Alternatively, the cross spectrum may be computed for each frequency bin k of the FFT. In this case, the subband b corresponds directly to one frequency bin [k].

In a third step 32, at least two different spatial coding parameters selected, for example, from the group of inter-channel time difference (ITD), values, inter-channel phase difference (IPD), values, inter-channel level difference (ILD), values, and inter-channel coherence (ICC), values are calculated. For example, a full band ITD, IPD and a fullband ICC parameter may be calculated based on the subband cross-spectrum coefficients.

A selection of at least one spatial coding parameter of the pluralities of spatial coding parameters may be performed on the basis of the values of the calculated spatial coding parameters. In particular, the selection may be based on a priority list of perceptually important spatial coding parameters. One example of how such a selection may be performed is explained in greater detail in the following.

In a decision step 33 it may be checked whether the ITD value is equal to zero. Alternatively, in the decision step 33 it may be checked whether the ITD value is lower than a threshold. The threshold may represent the minimum perceptually relevant ITD. All the ITD values lower than this threshold are then considered as negligible. For instance, with a sampling frequency of 48 kilohertz (kHz), absolute values of ITD lower than 3 are then considered as negligible. If the ITD value is not zero, then a quantized representation of the ITD parameter may be included into a parameter section of an audio bitstream 1 in step 33*a*, and a parameter type flag in the parameter section of the audio bitstream 1 indicating the type of the selected spatial coding parameter, i.e. the ITD parameter, being included into the audio bitstream 1 may be set in step 33*b*. The parameter type flag may, for example, be set to the flag value "1" to indicate that an ITD parameter is included. However, if the ITD value is equal to zero, then a decision step 34 may be implemented.

In the decision step 34 it may be checked whether the IPD value is equal to zero. Alternatively, in the decision step 34 it may be checked whether the IPD value is lower than a threshold. The threshold may for instance be set at the first IPD quantization step. All IPD values lower than this threshold are then considered as perceptually not relevant or negligible. If the IPD value is not zero, then a quantized representation of the IPD parameter may be included into a parameter section of an audio bitstream 1 in step 34*a*, and a parameter type flag in the parameter section of the audio bitstream 1 indicating the type of the selected spatial coding parameter, i.e. the IPD parameter, being included into the audio bitstream 1 may be set in step 34*b*. The parameter type flag may, for example, be set to the flag value "0" to indicate that an IPD parameter is included. However, if the IPD value is equal to zero, then a decision step 35 may be implemented.

In the decision step 35, it may be checked whether the ICC value is equal to one. If the ICC value is not one, then a quantized representation of the ICC parameter may be included into a parameter section of an audio bitstream 1 in step 35*a*, and a parameter type flag in the parameter section of the audio bitstream 1 indicating the type of the selected spatial coding parameter, i.e. the ICC parameter, being included into the audio bitstream 1 may be set in step 35*b*.

Alternatively, the parameter type flag in the parameter section of the audio bitstream 1 may be set to indicate a transmittal of the ITD parameter in step 35*b*. In step 35*c*, a quantized representation of the ITD parameter having a predetermined flag value may be included into the parameter section, thereby indicating the presence of the ICC parameter being included into the audio bitstream 1. That way, an otherwise unused quantization value for the ITD parameter may be used as flag indicator for the presence of the ICC parameter.

However, if the ICC value is equal to one (e.g. the ICC has no or only a negligible perceptual relevance), then instead of transmitting the ICC parameter, a parameter type flag in the parameter section of the audio bitstream 1 indicating the type of the selected spatial coding parameter, i.e. the ITD parameter, being included into the audio bitstream 1 may be set in step 36*a*. Additionally, in step 36*b* instead of the IPD or the ICC parameter, the ITD parameter may be transmitted with an ITD value of zero as determined in decision step 33 to indicate that none of the three spatial coding parameters has a perceptual relevance.

The perceptual importance of the different spatial encoding parameters may depend on the type of source signal. For voice signal or conversational application, the ITD is typically the most important spatial encoding parameter, followed by IPD, and finally by ICC.

The decision step 33 "checking whether the ITD value is equal to zero" is only one possible embodiment for checking whether the ITD parameter value fulfills a given selection criterion, which may be defined based on the specific requirements and type of the source signal. When digitizing the ITD by 15 values, e.g. from −7 to +7, the selection criterion may also be set, for example, to "if magnitude of ITD is smaller or equal to 1". In this case, the ITD parameter is only selected in case the magnitude of the ITD parameter value is 2 or greater, otherwise the next most relevant, e.g. the IPD parameter value is checked.

The same applies for the decision step 34 "checking whether the IPD value is equal to zero". This is only one possible embodiment for checking whether the IPD parameter value fulfills a given selection criterion, which again may be defined based on the specific requirements and type of the source signal and may be different to the selection criterion used for the ITD parameter. When digitizing the IPD by 16 values, e.g. 16 quantization steps from −pi to +pi, the selection criterion may also be set, for example, to "if magnitude of IPD is smaller or equal to the first quantization step". In this case, the IPD parameter is only selected in case the ITD does not fulfill the respective selection criterion and the magnitude of the IPD parameter value is equal or greater than the first quantization step, otherwise the next most relevant, e.g. the ICC parameter value is checked.

The embodiments of the method described based on FIG. 4 can be performed for stereo signals, i.e. multi-channel audio signals with a left (L) and a right (R) side audio channel signal, or for any other multi-channel signal, e.g. comprising two or more audio channel signals.

In case of stereo signals, embodiments may use one of the two audio channel signals as the reference signal and the spatial coding parameters are calculated (and for example the method as described based on FIG. 4 is performed) for the other audio channel signal only, which is sufficient to reconstruct the perceived spatial relationship of the two audio channels at the decoder. Other embodiments for stereo signals are adapted to obtain a downmix signal based on the two audio channel signals of the stereo signal and calculate the spatial parameters (and to perform for example the method as described based on FIG. 4) for each of the two audio signals and to transmit the selected spatial parameter(s) for each of the two audio channels to be able to reconstruct the perceived spatial relationship of the two audio channels at the decoder.

Figure 5:
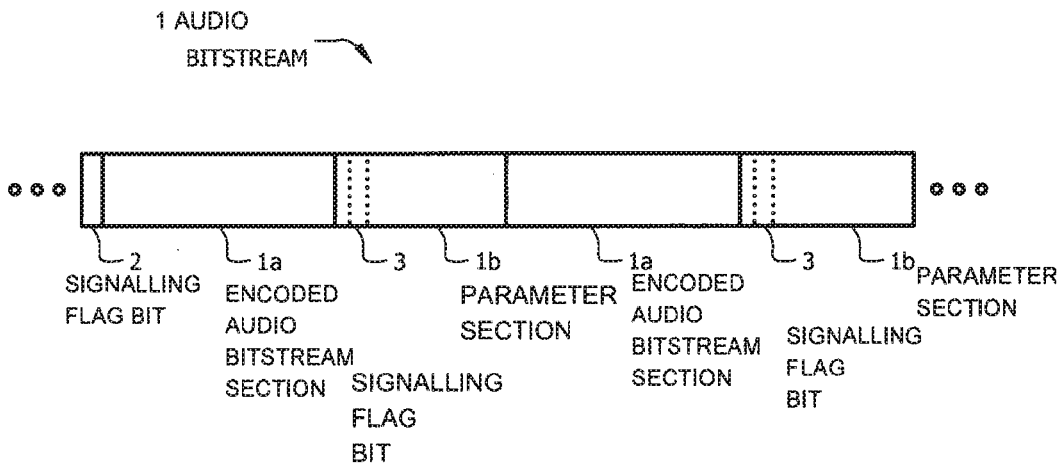
FIG. 5 schematically illustrates a first variant of a bitstream structure of an audio bitstream.
Figure 6A:
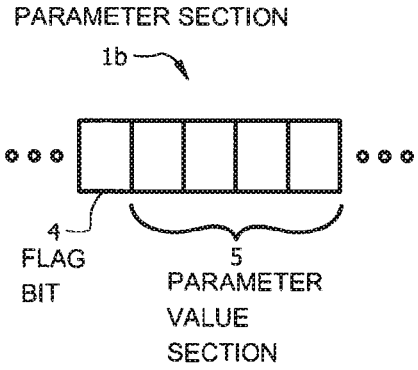
FIG. 6 schematically illustrates a second variant of a bitstream structure of an data bitstream.
Figure 6B:
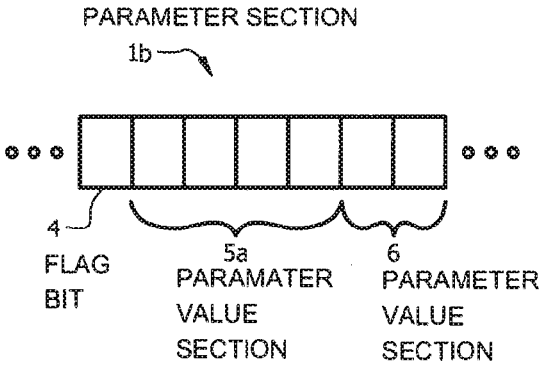
Figure 7:
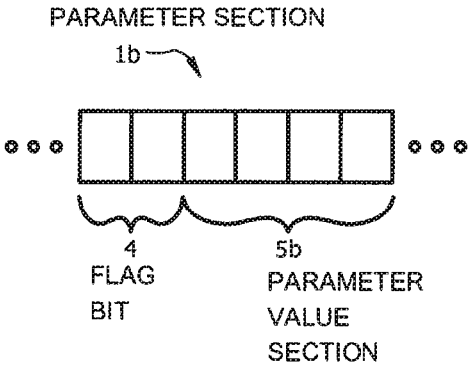
FIG. 7 schematically illustrates a third variant of a bitstream structure of an audio bitstream.

FIGS. 5 to 7 schematically illustrate variants of a bitstream structure of an audio bitstream, for example the audio bitstream 1 detailed in FIGS. 1 to 3.

In FIG. 5 the audio bitstream 1 may include an encoded audio bitstream section 1*a* and a parameter section 1*b*. The encoded audio bitstream section 1*a* and the parameter section 1*b* may alternate and their combined length may be indicative of the overall bitrate of the audio bitstream 1. The encoded audio bitstream section 1*a* may include the actual audio data to be decoded. The parameter section 1*b* may comprise one or more quantized representations of spatial coding parameters. The audio bitstream 1 may for example include a signaling flag bit 2 used for explicit signaling whether the audio bitstream 1 includes auxiliary data in the parameter section 1*b* or not. Furthermore, the parameter section 1*b* may include a signaling flag bit 3 used for implicit signaling whether the audio bitstream 1 includes auxiliary data in the parameter section 1*b* or not.

FIGS. 6A and 6B shows a first variant of bitstream structures of the parameter section 1*b* of the audio bitstream 1 as shown in FIG. 5. Case (a) pertains to scenarios where either the ITD parameter or the IPD parameter are not equal to zero. Case (b) pertains to scenarios where both the ITD parameter and the IPD parameter are equal to zero.

In FIG. 6, only one flag bit 4 is used to indicate which of the spatial coding parameters ITD and IPD are transmitted. Without loss of generality, a flag bit value of one may be used for the flag section 4 to indicate the presence of the ITD parameter and a flag bit value of zero may be used for the flag section 4 to indicate the presence of the IPD parameter. The ITD parameter and the IPD parameter may be included in quantized representation into the parameter value section 5 of the parameter section 1*b*. The quantized representation of the ITD parameter and the IPD parameter may each include 4 bits. However, any other number of bits for the quantized representation of the ITD parameter and the IPD parameter may be chosen as well.

Thus, in the most common case, where either the ITD parameter or the IPD parameter have values differing from zero, only 5 bits are used in the parameter section 1*b*. In the less common case, where both the ITD parameter and the IPD parameter have values equal to zero, the flag bit 4 may be set to one to indicate the presence of the ITD parameter. The parameter value section 5*a* may again include 4 bits, but the quantized representation of the ITD parameter may be chosen to indicate a value not associated with a valid ITD parameter value. For example, the ITD parameter may be quantized in integer values between −7 to 7. In that case, 15 different quantized representation values are necessary to code these integer values. The 16th possible quantized representation may be reserved to use the parameter value section 5*a* as implicit flagging section 3 as described with reference to FIG. 5. Whenever, the parameter value section 5*a* includes the 16th possible quantized representation, it is indicated that the following parameter value section 6 is reserved for the ICC parameter. The parameter value section 6 may for example include 2 bits, i.e. the ICC value may be quantized to 4 quantization values. However, any other number of bits may be possible for the parameter value section 6 as well.

The IPD parameter may in that case be quantized to 16 quantization values, since the IPD parameter is not used for implicit parameter flagging. It may alternatively be possible to quantize the IPD parameter to 15 quantization values instead of the ITD parameter and to use a 16th possible quantized representation of the IPD parameter for implicit parameter flagging.

FIG. 7 schematically illustrates a second variant for the parameter section 1*b* of the audio bitstream 1 as shown in FIG. 5. In contrast to the first variant, the flag section 4 may include 2 bits instead of 1. Therefore, each of the spatial coding parameters ITD, IPD and ICC may be assigned a specific flag bit value, for example "00" for ITD, "01" for IPD and "10" for ICC. In turn, only one parameter value section 5*b* needs to be used for the inclusion of the ITD, IPD and ICC parameters. The parameter value section 5*b* may again include 4 bits. With the second variant, the overall bit usage is 6 bits instead of 5 bits as in case (a) of FIG. 5, but there are no exceptional cases (b) where more than 6 bits need to be used.

The first variant may for example be used in application scenarios where ITD and IPD parameters are more important than the ICC parameter, for example in conversational applications transmitting speech data. In other scenarios, the second variant may be preferred. Considering that for conversational applications, voice signal is statistically the most important type of signal; ITD and IPD represent the most perceptually relevant parameters. It may be estimated that for 90% of the input signal, ITD or IPD will be the most relevant parameters, ICC representing only 10%. Hence, for 90% of the frames, one bit may be saved and used for other information (e.g. better quantization of ILD parameters). For only 10% of the frames, one additional bit is necessary. Hence, on overall, the total bit rate associated with the spatial coding parameters is then reduced.

The method 30 as shown in FIG. 4 may also be applied to multi-channel parametric audio coding. A cross spectrum may be computed per subband b and per each channel j as $$c_j[b]=\Sigma_{k=k_b}^{k_{b+1}-1} X_j[k]\cdot X_{ref}[k]^*,$$

wherein Xj[k] is the FFT coefficient of the channel j and Xref[k] is the FFT coefficient of a reference channel. The reference channel may be a select one of the plurality of channels j. Alternatively, the reference channel may be the spectrum of a mono downmix signal, which is the average over all channels j. In the former case, M−1 spatial cues are generated, whereas in the latter case, M spatial cues are generated, with M being the number of channels j. "*" denotes the complex conjugation, kb denotes the start bin of the subband b and kb+1 denotes the start bin of the neighbouring subband b+1. Hence, the frequency bins [k] of the FFT from kb to kb+1 represent the subband b.

Alternatively, the cross spectrum may be computed for each frequency bin k of the FFT. In this case, the subband b corresponds directly to one frequency bin [k].

For each channel j in the audio bitstream 1*a* respective parameter section 1*b* is provided, and for each channel j one of the spatial coding parameters may be selected independently and included the parameter section 1*b*.

What is claimed is:

1. A method implemented in a non-transitory computer-readable medium for parametric spatial audio coding of a multi-channel audio signal comprising a plurality of audio channel signals, the method comprising: calculating at least two different spatial coding parameters for an audio channel signal of the plurality of audio channel signals, wherein the at least two different spatial coding parameters are of at least two different types of spatial coding parameters and are calculated with regard to a reference audio signal, and wherein the reference audio signal is another audio channel signal of the plurality of audio channel signals or a downmix audio signal derived from at least two audio channel signals of the plurality of audio channel signals; selecting at least one spatial coding parameter of the at least two different spatial coding parameters associated with the audio channel signal on the basis of the values of the calculated spatial coding parameters; including a quantized representation of the selected spatial coding parameter into a parameter section of an audio bitstream; and setting a parameter type flag in the parameter section of the audio bitstream indicating the type of the selected spatial coding parameter being included into the audio bitstream wherein selecting the at least one spatial parameter comprises: selecting a first spatial coding parameter of a first spatial coding parameter type from the at least two spatial coding parameters in case the value of the first spatial coding parameter fulfills a predetermined first selection criterion associated to the first spatial coding parameter type; or selecting a second spatial coding parameter of a second spatial coding parameter type from the at least two spatial coding parameters in case the value of the first spatial coding parameter does not fulfill the predetermined first selection criterion associated to the first spatial coding parameter type and the value of the second spatial coding parameter fulfills a predetermined second selection criterion associated to the second spatial coding parameter type.

2. The method of claim 1, further comprising:

including a quantized representation of a predetermined flag value into the parameter section of the audio bitstream; and including a quantized representation of the selected spatial coding parameter into the parameter section of the audio bitstream together with the quantized representation of a predetermined flag value, thereby indicating the type of the selected spatial coding parameter being included into the audio bitstream.

3. The method of claim 1, wherein the quantized representation of the selected spatial coding parameter includes 4 bits.

4. The method of claim 3, wherein the parameter type flag includes 1 bit.

5. The method of claim 3, wherein the quantized representation of the predetermined flag value includes 4 bits.

6. The method of claim 1, wherein an inter-channel time difference value is quantized to 15 quantization values.

7. The method of claim 1, wherein an inter-channel phase difference value is quantized to 16 quantization values.

8. The method of claim 1, wherein an inter-channel coherence value is quantized to 4 quantization values.

9. The method of claim 1, wherein an inter-channel time difference value is quantized to 15 quantization values, wherein an inter-channel phase difference value is quantized to 16 quantization values, and wherein an inter-channel coherence value is quantized to 4 quantization values.

10. The method of claim 1, wherein the first spatial coding parameter and the second spatial coding parameter are each selected from a group consisting of: an inter-channel time difference (ITD), an inter-channel phase difference (IPD), an inter-channel level difference (ILD), and an inter-channel coherence (ICC).

11. A spatial audio coding device for a multi-channel audio signal comprising a plurality of audio channel signals, the spatial audio coding device implemented in a hardware processor and comprising:

a parameter estimation module configured to calculate, by the hardware processor, at least two different spatial coding parameters for an audio channel signal of the plurality of audio channel signals, wherein the at least two different spatial coding parameters are of at least two different types of spatial coding parameters and are calculated with regard to a reference audio signal, and wherein the reference audio signal is another audio channel signal of the plurality of audio channel signals or a downmix audio signal derived from at least two audio channel signals of the plurality of audio channel signals;

a parameter selection module coupled to the parameter estimation module and configured to select, by the hardware processor, at least one spatial coding parameter of the at least two different spatial coding parameters associated with the audio channel signal on the basis of the values of the calculated spatial coding parameters; and a streaming module coupled to the parameter estimation module and the parameter selection module and configured to:

generate, by the hardware processor, an audio bitstream comprising a parameter section comprising a quantized representation of the selected spatial coding parameter and to set a parameter type flag in the parameter section of the audio bitstream indicating the type of the selected spatial coding parameter being included into the audio bitstream; and select, by the hardware processor, a first spatial coding parameter of a first spatial coding parameter type from the at least two spatial coding parameters in case the value of the first spatial coding parameter fulfills a predetermined first selection criterion associated to the first spatial coding parameter type; or select, by the hardware processor, a second spatial coding parameter of a second spatial coding parameter type from the at least two spatial coding parameters in case the value of the first spatial coding parameter does not fulfill the predetermined first selection criterion associated to the first spatial coding parameter type and the value of the second spatial coding parameter fulfills a predetermined second selection criterion associated to the second spatial coding parameter type.

12. The spatial audio coding device of claim 11, further comprising a downmixing module configured to generate, by the hardware processor, the downmix audio signal by downmixing the plurality of audio channel signals.

13. The spatial audio coding device of claim 12, further comprising an encoding module coupled to the downmixing module and configured to generate, by the hardware processor, an encoded audio bitstream comprising an encoded downmixed audio bitstream.

14. The spatial audio coding device of the claim 11, further comprising a transformation module configured to apply, by the hardware processor, a transformation from a time domain to a frequency domain to the plurality of audio channel signals.

15. The spatial audio coding device of claim 14, wherein the streaming module is further configured to set, by the hardware processor, a flag in the audio bitstream, and wherein the flag indicates the presence of at least one spatial coding parameter in the parameter section of the audio bitstream.

16. The spatial audio coding device of claim 15, wherein the flag is set, by the hardware processor, for the whole audio bitstream or is part of the parameter section of the audio bitstream.

* * * * *